US009196411B2

(12) United States Patent
Parsche

(10) Patent No.: US 9,196,411 B2
(45) Date of Patent: Nov. 24, 2015

(54) SYSTEM INCLUDING TUNABLE CHOKE FOR HYDROCARBON RESOURCE HEATING AND ASSOCIATED METHODS

(71) Applicant: Harris Corporation, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 485 days.

(21) Appl. No.: 13/657,172

(22) Filed: Oct. 22, 2012

(65) Prior Publication Data

US 2014/0110395 A1 Apr. 24, 2014

(51) Int. Cl.

| | |
|---|---|
| ***H05B 1/02*** | (2006.01) |
| ***H01F 21/08*** | (2006.01) |
| ***E21B 43/24*** | (2006.01) |
| ***H01Q 1/04*** | (2006.01) |
| ***H05B 6/52*** | (2006.01) |
| ***H05B 6/80*** | (2006.01) |

(52) U.S. Cl.

CPC ..... *H01F 21/08* (2013.01); *E21B 43/2401* (2013.01); *H01Q 1/04* (2013.01); *H05B 6/52* (2013.01); *H05B 6/80* (2013.01); *H05B 2214/03* (2013.01)

(58) Field of Classification Search

CPC ..... H01F 21/08; E21B 43/2401; H05B 6/52; H05B 6/80; H05B 2214/03

USPC ..... 219/494, 497, 121.54, 481; 392/301–306; 343/895, 892

See application file for complete search history.

(56) References Cited

U.S. PATENT DOCUMENTS

| | | | | |
|---|---|---|---|---|
| 3,032,726 | A * | 5/1962 | Fink | 333/263 |
| 4,140,179 | A | 2/1979 | Kasevich et al. | |
| 4,508,168 | A | 4/1985 | Heeren | |
| 4,524,826 | A | 6/1985 | Savage | |
| 4,583,589 | A * | 4/1986 | Kasevich | 166/60 |
| 5,723,844 | A | 3/1998 | Dow et al. | |
| 6,169,523 | B1 * | 1/2001 | Ploussios | 343/895 |
| 2009/0050318 | A1 * | 2/2009 | Kasevich | 166/248 |
| 2010/0219182 | A1 | 9/2010 | Parsche | |
| 2010/0223011 | A1 | 9/2010 | Parsche | |
| 2012/0067580 | A1 | 3/2012 | Parsche | |
| 2012/0125608 | A1 | 5/2012 | Parsche | |

FOREIGN PATENT DOCUMENTS

| | | |
|---|---|---|
| GB | 2341442 | 3/2000 |
| JP | 11325376 | 11/1999 |

* cited by examiner

*Primary Examiner* — Mark Paschall

(74) *Attorney, Agent, or Firm* — Allen, Dyer, Doppelt, Milbrath & Gilchrist, P.A.

(57) ABSTRACT

A system and method for heating a hydrocarbon resource in a subterranean formation having a wellbore extending therein, include the use of a radio frequency (RF) source, an RF antenna to be positioned within the wellbore and a transmission line coupling the RF source and the RF antenna. A tunable choke is positioned on the transmission line between the RF source and RF antenna, and a controller is coupled to the tunable choke. The controller may be configured to tune the tunable choke to reduce a common mode current from propagating on an outside of the transmission line toward the RF source.

16 Claims, 3 Drawing Sheets

SYSTEM INCLUDING TUNABLE CHOKE FOR HYDROCARBON RESOURCE HEATING AND ASSOCIATED METHODS

FIELD OF THE INVENTION

The present invention relates to the field of hydrocarbon resource heating, and, more particularly, to hydrocarbon resource heating from a wellbore in a subterranean formation using electromagnetic energy and related methods.

BACKGROUND OF THE INVENTION

Subterranean formation heating using electromagnetic energy relates to the technology for heating of bitumen and/or heavy oil in oil-sand mediums using radio frequency (electromagnetic) energy. Radio frequency heating uses antennas or electrodes to heat the buried formation. This enables a quick and efficient heating of hydrocarbons by coupling antennas into the formation. As a result, the heated hydrocarbons become less viscous which aids in oil production.

Materials such as oil shale, tar sands, and coal are amenable to heat processing to produce hydrocarbon liquids. Generally, the heat develops the porosity, permeability, and/or mobility necessary for recovery. Oil shale is a sedimentary rock, which upon pyrolysis, or distillation, yields a condensable liquid, referred to as a shale oil, and non-condensable gaseous hydrocarbons. The condensable liquid may be refined into products that resemble petroleum products. Oil sand is an erratic mixture of sand, water, and bitumen, with the bitumen typically being present as a film around water-enveloped sand particles. Though difficult, various types of heat processing can release the bitumen, which is an asphalt-like crude oil that is highly viscous.

A number of proposals, broadly classed as in-situ methods, have been made for processing and recovering hydrocarbon deposits. Such methods may involve underground heating of material in place, with little or no mining or disposal of solid material in the formation. Useful constituents of the formation, including heated liquids of reduced viscosity, may be drawn to the surface by a pumping system or forced to the surface by injection techniques. For such methods to be successful, the amount of energy required to effect the extraction should be minimized.

One proposed electrical in situ approach employs a set of arrays of dipole antennas located in a plastic or other dielectric casing in a formation, such as a tar sand formation. A VHF or UHF power source would energize the antennas and cause radiating fields to be emitted into the deposit. However, at these frequencies, and considering the electrical properties of the formations, the field intensity drops rapidly as distance from the antennas increases. Consequently, non-uniform heating results in inefficient overheating of portions of formations to obtain at least minimum average heating of the bulk of the formation.

Many efforts have been attempted or proposed to heat large volumes of subsurface formations in situ using electric resistance, gas burner heating, steam injection and electromagnetic energy, such as to obtain kerogen oil and gas from oil shale. Resistance type electrical elements have been positioned down a borehole via a power cable to heat the shale via conduction. Electromagnetic energy has been delivered via an antenna or microwave applicator. The antenna is positioned down a borehole via a coaxial cable or waveguide connecting it to a high-frequency power source on the surface. Shale heating is accomplished by radiation and dielectric absorption of the energy of the electromagnetic (EM) wave radiated by the antenna or applicator. This may be better than more common resistance heating which relies solely on conduction to transfer the heat. It is also better than steam heating which requires large amounts of water and energy present at the site.

U.S. Pat. No. 4,140,179 discloses a system and method for producing subsurface heating of a formation comprising a plurality of groups of spaced RF energy radiators (dipole antennas) extending down boreholes to oil shale. The antenna elements should be matched to the electrical conditions of the surrounding formations. However, as the formation is heated, the electrical conditions can change whereby the dipole antenna elements may have to be removed and changed due to changes in temperature and content of organic material.

U.S. Pat. No. 4,508,168 describes an RF applicator positioned down a borehole supplied with electromagnetic energy through a coaxial transmission line whose outer conductor terminates in a choking structure comprising an enlarged coaxial stub extending back along the outer conductor.

However, RF currents flow along the outside of the coaxial cable (e.g. common mode current) and result in unwanted overburden heating or even hazardous surface heating. The conventional sleeve baluns or common mode chokes are intended to stop the unwanted current but the transmitter frequency is tuned to track the natural resonance of the antenna. Such a balun will not follow in frequency by itself.

SUMMARY OF THE INVENTION

In view of the foregoing background, it is therefore an object of the present invention to provide a more reliable and efficient approach for reducing or eliminating a common mode current from having undesirable effects during subterranean RF heating of hydrocarbon resources.

This and other objects, features, and advantages in accordance with the present invention are provided by a system for heating a hydrocarbon resource in a subterranean formation having a wellbore extending therein, the system including a radio frequency (RF) source, an RF antenna to be positioned within the wellbore and a transmission line coupling the RF source and the RF antenna. A tunable choke is positioned on the transmission line between the RE source and RF antenna, and a controller is coupled to the tunable choke.

Another aspect is directed to a method for heating a hydrocarbon resource in a subterranean formation having a wellbore extending therein. The method includes coupling an RF source to a radio frequency (RF) antenna via a transmission line, and positioning the RF antenna within the wellbore so that the RF antenna is adjacent the hydrocarbon resource, and coupling a tunable choke on the transmission line between the RF source and the RF antenna. The method may also include operating the RF source so that the RF antenna supplies RF power to the hydrocarbon resource in the subterranean formation; and operating the tunable choke to reduce a common mode current from propagating on an outside of the transmission line toward the RF source.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
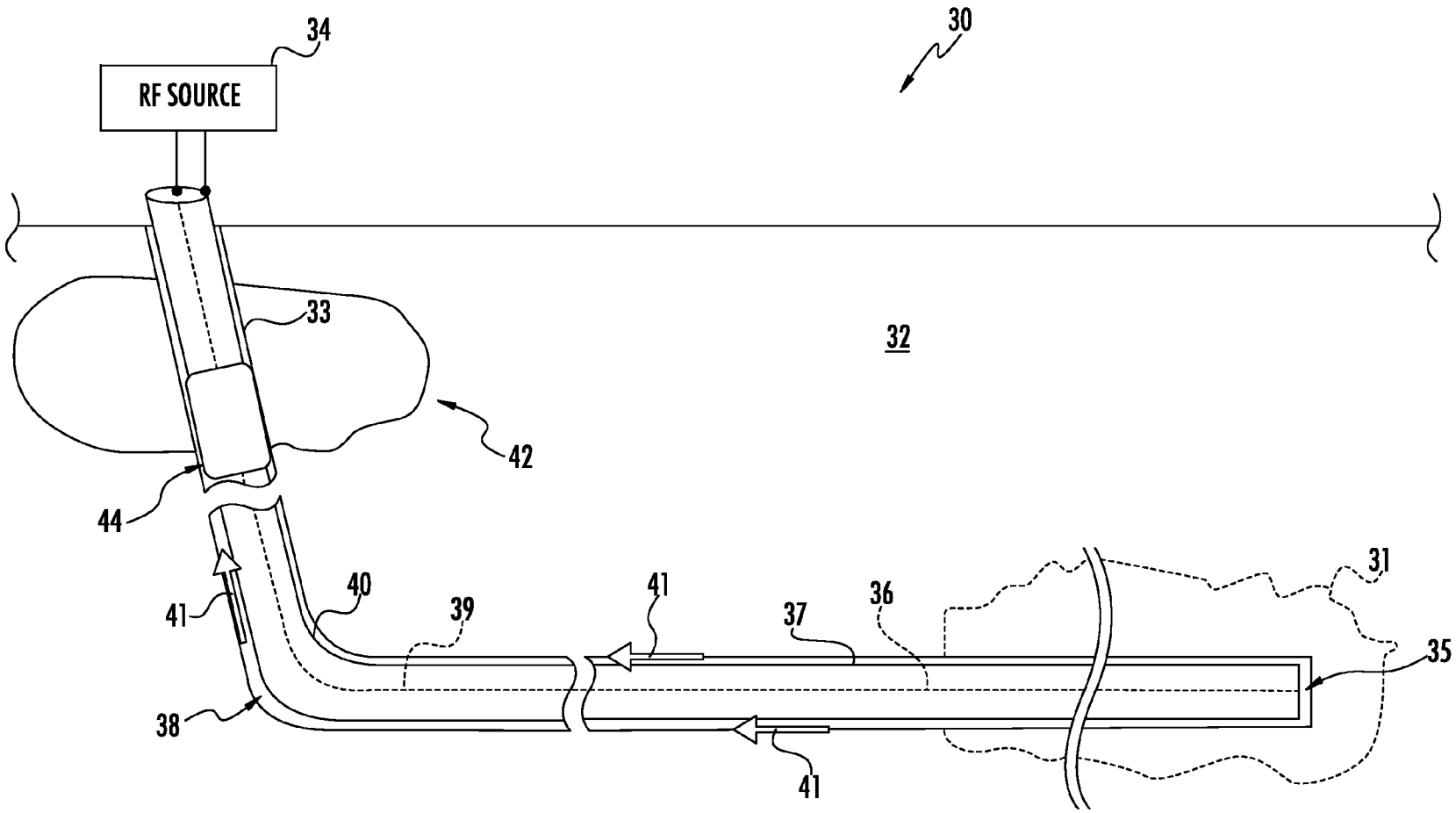
FIG. 1 is a schematic diagram illustrating a system for heating a hydrocarbon resource in accordance with an embodiment of the present invention.

Referring initially to FIG. 1, a system 30 for heating a hydrocarbon resource 31 (e.g., oil sands, etc.) in a subterranean formation 32 having a wellbore 33 therein is first described. In the illustrated example, the wellbore 33 is a laterally extending wellbore, although the system 30 may be used with vertical or other wellbores in different configurations. The system 30 further includes a radio frequency (RF) source 34 for an RF antenna 35 that is positioned in the wellbore 33 adjacent the hydrocarbon resource 31. The RF source 34 is positioned above the subterranean formation 32, and may be an RF power generator, for example. In an exemplary implementation, the laterally extending wellbore 33 may extend about 1,000 feet in length within the subterranean formation 32, and about 50 feet underground, although other depths and lengths may be used in different implementations.

Although not shown, in some embodiments a second wellbore may be used below the wellbore 33, such as in a SAGD implementation, for collection of petroleum, etc., released from the subterranean formation 32 through heating. The second wellbore may optionally include a separate antenna for providing additional heat to the hydrocarbon resource 31, as would be appreciated by those skilled in the art.

A transmission line 38 extends within the wellbore 33 between the RF source 34 and the RF antenna 35. The RF antenna 35 includes an inner conductor 36 and an outer tubular conductor 37, which advantageously defines a dipole antenna. However, it will be appreciated that other antenna configurations may be used in different embodiments. A dielectric may separate the inner conductor 36 and the outer tubular conductor 37, and these conductors may be coaxial in some embodiments. The outer tubular conductor 37 will typically be partially or completely exposed to radiate RF energy into the hydrocarbon resource 31.

The transmission line 38 may include a plurality of separate segments which are successively coupled together as the RF antenna is pushed or fed down the wellbore 33. The transmission line 38 may also include an inner conductor 39 and an outer tubular conductor 40, which may be separated by a dielectric material D, for example. A dielectric may also surround the outer tubular conductor 40, if desired. In some configurations, the inner conductor 39 and the outer tubular conductor 40 may be coaxial, although other transmission line conductor configurations may also be used in different embodiments.

In accordance with embodiments herein, electromagnetic radiation provides heat to the hydrocarbon formation, which allows heavy hydrocarbons to flow. In those embodiments, no steam is actually necessary to heat the formation, which provides a significant advantage especially in hydrocarbon formations that are relatively impermeable and of low porosity, which makes traditional SAGD systems slow to start. The penetration of RF energy is not inhibited by mechanical constraints, such as low porosity or low permeability. However, RF energy can be beneficial to preheat the formation prior to steam application.

Radio frequency (RF) heating is heating using one or more of three energy forms: electric currents, electric fields, and magnetic fields at radio frequencies. Depending on operating parameters, the heating mechanism may be resistive by joule effect or dielectric by molecular moment. Resistive heating by joule effect is often described as electric heating, where electric current flows through a resistive material. Dielectric heating occurs where polar molecules, such as water, change orientation when immersed in an electric field. Magnetic fields also heat electrically conductive materials through eddy currents, which heat resistively.

RF heating can use electrically conductive antennas to function as heating applicators. The antenna is a passive device that converts applied electrical current into electric fields, magnetic fields, and electrical currents in the target material, without having to heat the structure to a specific threshold level. Preferred antenna shapes can be Euclidian geometries, such as lines and circles. Additional background information on dipole antenna can be found at S. K. Schelkunoff & H. T. Friis, Antennas: Theory and Practice, pp 229-244, 351-353 (Wiley New York 1952). The radiation patterns of antennas can be calculated by taking the Fourier transforms of the antennas' electric current flows. Modern techniques for antenna field characterization may employ digital computers and provide for precise RF heat mapping.

Susceptors are materials that heat in the presence of RF energies. Salt water is a particularly good susceptor for RF heating; it can respond to all three types of RF energy. Oil sands and heavy oil formations commonly contain connate liquid water and salt in sufficient quantities to serve as a RF heating susceptor. For instance, in the Athabasca region of Canada and at 1 KHz frequency, rich oil sand (15% bitumen) may have about 0.5-2% water by weight, an electrical conductivity of about 0.01 s/m (siemens/meter), and a relative dielectric permittivity of about 120. As bitumen melts below the boiling point of water, liquid water may be a used as an RF heating susceptor during bitumen extraction, permitting well stimulation by the application of RF energy.

In general, RF heating has superior penetration to conductive heating in hydrocarbon formations. RF heating may also have properties of thermal regulation because steam is a not an RF heating susceptor.

Although not so limited, heating from the present embodiments may primarily occur from reactive near fields rather than from radiated far fields. The heating patterns of electrically small antennas in uniform media may be simple trigonometric functions associated with canonical near field distributions. For instance, a single line shaped antenna, for example, a dipole, may produce a two petal shaped heating pattern due to the cosine distribution of radial electric fields as displacement currents (see, for example, Antenna Theory Analysis and Design, Constantine Balanis, Harper and Roe, 1982, equation 4-20a, pp 106). In practice, however, hydrocarbon formations are generally inhomogeneous and anisotropic such that realized heating patterns are substantially modified by formation geometry. Multiple RF energy forms including electric currents, electric fields, and magnetic fields interact as well, such that canonical solutions or hand calculation of heating patterns may not be practical or desirable.

Heating patterns may be predicted by logging the electromagnetic parameters of the hydrocarbon formation a priori, for example, conductivity measurements can be taken by induction resistivity and permittivity by placing tubular plate sensors in exploratory wells. The RF heating patterns are then calculated by numerical methods in a digital computer using method or moments algorithms such as the Numerical Electromagnetic Code Number 4.1 by Gerald Burke and the Lawrence Livermore National Laboratory of Livermore Calif.

Far field radiation of radio waves (as is typical in wireless communications involving antennas) does not significantly occur in antennas immersed in hydrocarbon formations. Rather the antenna fields are generally of the near field type so the flux lines begin and terminate on the antenna structure. In free space, near field energy rolls off at a $1/r^3$ rate (where r is the range from the antenna conductor) and for antennas small relative wavelength it extends from there to $\lambda/2\Pi$ (lambda/2 pi) distance, where the radiated field may then predominate. In the hydrocarbon formation, however, the antenna near field behaves much differently from free space. Analysis and testing has shown that dissipation causes the roll off to be much higher, about $1/r^5$ to $1/r^8$. This advantageously may limit the depth of heating penetration in the present embodiments to substantially that of the hydrocarbon formation.

Thus, the present approach can accomplish stimulated or alternative well production by application of RF electromagnetic energy in one or all of three forms: electric fields, magnetic fields and electric currents for increased heat penetration and heating speed. The RF heating may be used alone or in conjunction with other methods and the applicator antenna is provided in situ by the well tubes through devices and methods described.

RF currents 41 (e.g. common mode current) can sneak up the outside of the coaxial cable 38 and result in unwanted overburden 42 heating or even hazardous surface 32 heating. The overburden is frequently more electrically conductive than the hydrocarbon ore, so it may heat more readily than the hydrocarbon ore, and the present invention advantageously prevents the unwanted overburden heating. The conventional sleeve baluns or common mode chokes are intended to stop the unwanted current but the transmitter frequency is tuned to track the natural resonance of the antenna 35. Such baluns will not follow in frequency by itself. A more reliable and efficient approach for reducing or eliminating a common mode current from having undesirable effects during subterranean RF heating of hyrdrocarbon resources is now described.

Figure 2:
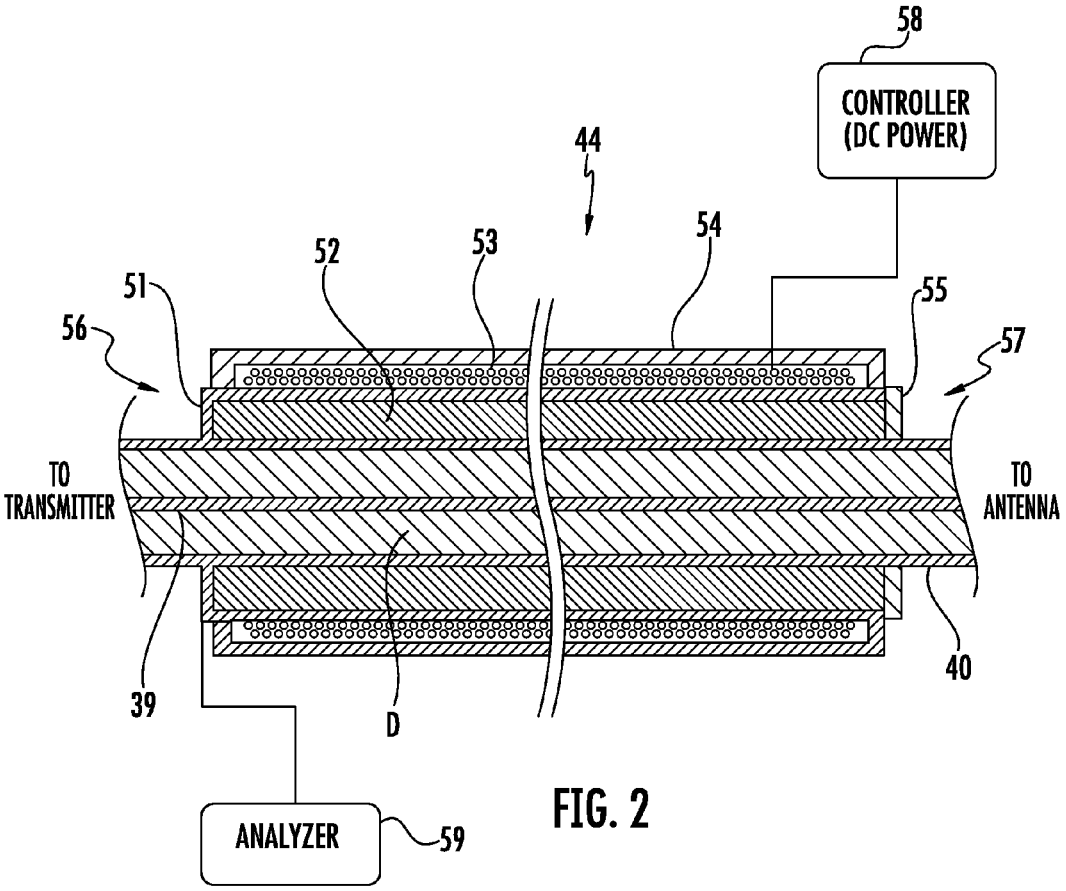
FIG. 2 is a schematic diagram illustrating further details of the tunable choke of the system in FIG. 1.

Referring additionally to FIG. 2, a tunable choke 44 is positioned on the transmission line 38 between the RF source 34 and RF antenna 35, and a controller 57 is coupled to the tunable choke 44. For example, the controller 57 may include a controllable DC power source. The controller 57 is configured to tune the tunable choke 44 to reduce a common mode current 41 from propagating on an outside of the transmission line 38 toward the RF source 34.

As illustrated in the embodiment of FIG. 2, the tunable choke 44 includes a conductive choke sleeve 51, e.g. a metallic cylinder, such as a copper cylinder, positioned on the transmission line 38 and including a closed end 56 electrically connected to the outer conductor 40 thereof. A biasable media 52 is surrounded by the conductive choke sleeve 51 adjacent the transmission line 38. The biasable media may include a saturable magnetic core, such as ferrite, magnetic spinel, powdered iron, penta-carbonyl E iron, ferrite lodestone, magnetite and steel laminate. The bias able media may be a liquid biasable media 52 such as a ferrofluid or a cast biasable media such as mixture of magnetic particles and a binder such as silicon rubber. Magnetic fields tend to act inside atoms while electric fields interact between atoms. In other words, magnetic atoms are preferred elements for the biasable media 52, alone or in combination with other elements. The permeable, magnetic atoms include (but are not limited to) iron, nickel, cobalt, and gadolinium. An electromagnet winding 53, e.g. a copper winding, is positioned around the conductive choke sleeve 51. An outer frame 54, e.g. a silicon steel frame, surrounds the electromagnet winding 53. A permanent magnet may accompany the electromagnet winding 53.

The conductive choke sleeve 51 includes a second end 57 opposite the closed end 56, and a dielectric member 55 is adjacent thereto. Such dielectric member 55, or spacer, and the conductive choke sleeve 51 enclose the biasable media 52 adjacent the transmission line 38. An analyzer 59 may be provided to measure the tuned frequency of the tunable choke 44 so that the tuned frequency of the choke 44 can closely match the RF frequency of the RF antenna 35.

The electromagnet winding 53 creates a DC magnetic field which penetrates the choke sleeve 51 and reaches the biasable media 52, e.g. ferrite, to change the permeability and raise the frequency of the tunable choke 44, for example, over a tuning range of 6 to 1. The biasable media 52 forms a coaxial magnetic circuit with the outer frame 54. The outer conductor 40 of the transmission line 38 shields the RF antenna current from the DC magnetic current. Because of radio frequency skin effect, DC magnetic fields may penetrate the conductive outer conductor of the 40 but radio frequency magnetic fields will not. This conductive outer conductor 40 is a low pass filter to magnetic fields, and this is true, for example, for a copper or steel conductive outer conductor 40.

Figure 3:
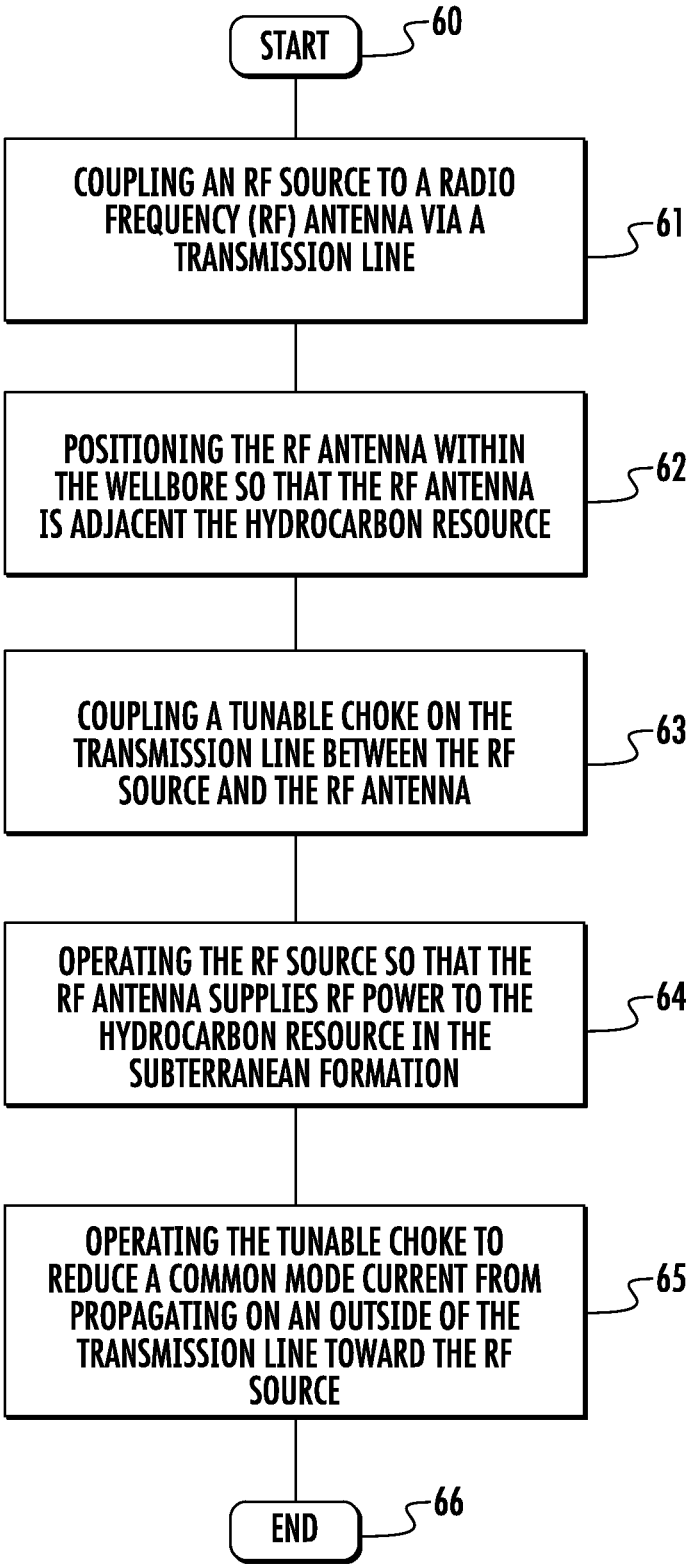
FIG. 3 is flowchart illustrating steps of a method in accordance with an embodiment of the present invention.

A method aspect will be described with reference to the flowchart in FIG. 3. The method is for heating a hydrocarbon resource 31 in a subterranean formation having a wellbore 33 extending therein. The method begins 60 and includes coupling an RF source 34 to a radio frequency (RF) antenna 35 via a transmission line 38 (block 61), and, at block 62, positioning the RF antenna 35 within the wellbore 33 so that the RF antenna 35 is adjacent the hydrocarbon resource 31.

At block 63, the method continues with coupling a tunable choke 44 on the transmission line 38 between the RF source 34 and the RF antenna 35, and, at block 64, operating the RF source 34 so that the RF antenna 35 supplies RF power to the hydrocarbon resource 31 in the subterranean formation. At block 65, the method includes operating the tunable choke 44 to reduce a common mode current 41 from propagating on an outside of the transmission line 38 toward the RF source 34, before ending at 66.

Coupling the tunable choke 44 includes positioning a conductive choke sleeve 51 on the transmission line 38 and including electrically connecting a closed end 56 to the outer conductor 40 thereof. A biasable media 52 is provided within the conductive choke sleeve 51 adjacent the transmission line 38, and an electromagnet winding 53 is positioned around the conductive choke sleeve 51. The electromagnet winding 53 is surrounded with an outer frame 54.

A physical scale model of a tunable common mode choke 41 was constructed as an example embodiment of the invention. It used a quantity of 21 nickel zinc ferrite toroids as the biasable media 51, and these were slipped over a ⅛ inch metal rod. The ⅛ inch rod emulated a transmission line 38 and or a steel well pipe at scale. The toroids were Amidon-Micrometals type FT-50-61 which have a relative permeability of 125, without the application of a biasing magnetic field. A ½ inch (nominal) water pipe was slipped over the beads to form the conductive choke sleeve 51. 400 turns of #26 AWG enameled copper wire formed the electromagnet winding 53. Without application of a DC biasing control current, the resonant frequency of the scale model common mode choke 41 was 22 MHz. 1 ampere of control current resulted in a tunable choke resonant frequency of 58 MHz. Application of 2.1 amperes of DC control current to the electromagnet resulted in saturation of the ferrite toroids and a new resonant frequency of 150 MHz. So a 6.8 to 1 tuning range was realized in the scale model and any resonant frequency desired between 22 and 150 MHz could be obtained by varying the DC control current between about 0 and 2.1 amperes respectively. The tuning range is approximately the square root of the magnetic permeability change in the biasable media 52, so in the scale model the magnetic permeability changed by a factor of about $(6.8)^2=46$. The relative permeability at magnetic saturation was about 125/46=2.7. Nickel zinc ferrite can have a relative dielectric permittivity of about 12 and this may be a fixed component of the tuning.

The length of a tunable common mode choke 21 may be calculated in some instances by the formula:

$$L\approx 0.24(c/f_r)(1/\sqrt{\mu_r \in_r})$$

Where:

L=length of the conductive choke sleeve 51, meters c=speed of light, meters per second $f_r$=the resonant frequency of the tunable common mode choke 41, in Hertz μr=relative permeability of the biasable media 51, a dimensionless number ∈r=relative permittivity of the biasable media 51, dimensionless number.

Operation of the tunable common mode choke 21 is not however limited to only this combination of frequency, length, etc., as for instance harmonic resonances may be used, and the tunable choke 21 may be useable away from resonance as well.

Accordingly, it will be appreciated that a more reliable and efficient approach for reducing or eliminating a common mode current 41 from having undesirable effects during subterranean RF heating of hyrdrocarbon resources 31 is described herein. Such RF currents 41 (i.e. common mode current) are reduced or eliminated from propagating up the outside of the coaxial cable 38. As such, unwanted overburden 42 heating or hazardous surface 32 heating is reduced and/or prevented.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A system for heating a hydrocarbon resource in a subterranean formation having a wellbore extending therein, the system comprising:

a radio frequency (RF) source;

an RF antenna operable to be positioned within the wellbore;

a transmission line coupling the RF source and the RF antenna;

a tunable choke positioned on the transmission line between the RF source and RF antenna, and configured to generate a magnetic field to change a magnetic permeability to adjust a resonant frequency thereof; and a controller coupled to said tunable choke.

2. The system according to claim 1 wherein said controller is configured to tune said tunable choke to reduce a common mode current from propagating on an outside of the transmission line toward the RF source.

3. The system according to claim 1 wherein the transmission line comprises an outer conductor; and wherein the tunable choke comprises:

an electrically conductive choke sleeve positioned on the transmission line and including a closed end electrically connected to the outer conductor thereof;

a biasable media surrounded by the electrically conductive choke sleeve adjacent the transmission line and having the magnetic permeability;

an electromagnet winding positioned around the conductive choke sleeve and configured to generate the magnetic field to change the magnetic permeability of the biasable media; and an outer frame surrounding the electromagnet winding.

4. The system according to claim 3 wherein the transmission line comprises a radio frequency (RF) coaxial cable transmission line.

5. The system according to claim 3, wherein the electrically conductive choke sleeve includes a second end opposite the closed end; and further comprising a dielectric member adjacent the second end of the electrically conductive choke sleeve and, together with the electrically conductive choke sleeve, enclosing the biasable media adjacent the transmission line.

6. The system according to claim 3, wherein the electrically conductive choke sleeve comprises a copper cylinder.

7. The system according to claim 3, wherein the electromagnet winding comprises a copper winding.

8. The system according to claim 3, wherein the biasable media comprises a saturable magnetic core.

9. The system according to claim 8, wherein the saturable magnetic core comprises at least one of ferrite, magnetic spinel, powdered iron, ferrite lodestone, magnetite and steel laminate.

10. The system according to claim 3, wherein the outer frame comprises a silicon steel frame.

11. A tunable choke for use with a transmission line and associated antenna operative to be positioned in a wellbore of a subterranean formation, the transmission line having an outer conductor, the tunable choke comprising:

an electrically conductive choke sleeve configured to be positioned on the transmission line and including a closed end to be electrically connected to the outer conductor thereof;

a biasable media surrounded by the electrically conductive choke sleeve adjacent the transmission line and having a permeability controlled by a magnetic field;

an electromagnet winding positioned around the electrically conductive choke sleeve and configured to generate the magnetic field to change the permeability of the biasable media in order to adjust a frequency of the tunable choke; and an outer frame surrounding the electromagnet winding.

12. The tunable choke according to claim 11, wherein the electrically conductive choke sleeve includes a second end opposite the closed end; and further comprising a dielectric member adjacent the second end of the electrically conductive choke sleeve and, together with the electrically conductive choke sleeve, enclosing the biasable media adjacent the transmission line.

13. The tunable choke according to claim 11, wherein the electrically conductive choke sleeve comprises a copper cylinder.

14. The tunable choke according to claim 11, wherein the electromagnet winding comprises a copper winding.

15. The tunable choke according to claim 11, wherein the biasable media comprises a saturable magnetic core.

16. The tunable choke according to claim 11, wherein the saturable magnetic core comprises at least one of ferrite, magnetic spinel, powdered iron, ferrite lodestone, magnetite and steel laminate.

* * * * *